US005892457A

United States Patent [19]

Kim

[11] Patent Number: 5,892,457

[45] Date of Patent: Apr. 6, 1999

[54] AUDIO PAGING APPARATUS AND METHOD FOR CORDLESS PAGING RECEIVER

[75] Inventor: Dong-Sub Kim, Gumi, Rep. of Korea

[73] Assignee: SamSung Electronics Co., Ltd., Suwon, Rep. of Korea

[21] Appl. No.: 670,594

[22] Filed: Jun. 26, 1996

[30] Foreign Application Priority Data

Jun. 26, 1995 [KR] Rep. of Korea ..... 1995-17607

[51] Int. Cl.[6] ..... G08B 5/22

[52] U.S. Cl. ..... 340/825.48; 340/825.44

[58] Field of Search ..... 340/825.44, 825.48, 340/825.47, 825.27

[56] References Cited

U.S. PATENT DOCUMENTS

| | | | |
|---|---|---|---|
| 4,263,480 | 4/1981 | Levine . | |
| 4,330,780 | 5/1982 | Masaki | 340/825.44 |
| 4,419,668 | 12/1983 | Ganucheau, Jr. | 340/825.44 |
| 4,460,960 | 7/1984 | Anderson et al. . | |
| 4,479,124 | 10/1984 | Rodriguez et al. . | |
| 4,675,863 | 6/1987 | Paneth et al. . | |
| 4,701,943 | 10/1987 | Davis et al. | 379/57 |
| 4,766,434 | 8/1988 | Matai et al. . | |
| 4,769,642 | 9/1988 | Davis et al. . | |
| 4,811,376 | 3/1989 | Davis et al. | 379/57 |
| 4,821,308 | 4/1989 | Hashimoto . | |
| 4,873,520 | 10/1989 | Fisch et al. . | |
| 4,885,577 | 12/1989 | Nelson . | |
| 4,935,735 | 6/1990 | DeLuca et al. . | |
| 4,949,085 | 8/1990 | Fisch et al. | 340/825.44 |
| 4,962,545 | 10/1990 | Klaczak et al. | 455/200 |
| 4,965,569 | 10/1990 | Bennett et al. | 430/825.44 |
| 5,047,763 | 9/1991 | Kuznicki et al. . | |
| 5,117,449 | 5/1992 | Metroka et al. | 379/58 |
| 5,151,929 | 9/1992 | Wolf | 379/57 |
| 5,153,579 | 10/1992 | Fisch et al. | 340/825.22 |
| 5,307,059 | 4/1994 | Connary et al. | 340/825.44 |
| 5,363,090 | 11/1994 | Cannon et al. | 340/825.44 |
| 5,392,452 | 2/1995 | Davis . | |
| 5,412,719 | 5/1995 | Hamamoto et al. | 380/9 |
| 5,423,062 | 6/1995 | Sakakura | 455/54.1 |
| 5,561,702 | 10/1996 | Lipp et al. | 379/57 |
| 5,604,492 | 2/1997 | Abdul-Halim | 340/825.44 |
| 5,733,131 | 3/1998 | Park | 434/307 R |

*Primary Examiner*—Brian Zimmerman
*Assistant Examiner*—Edward Merz
*Attorney, Agent, or Firm*—Robert E. Bushnell, Esq.

[57] ABSTRACT

In an audio paging apparatus and method for a cordless paging receiver for performing an alarm function in an audio signal during a cordless paging operation, the apparatus includes a receiver for receiving cordless paging information and converting the same into digital data, a memory for storing a self-address of the cordless paging receiver, a decoder for receiving and decoding the digital data, converting the same into the original data and outputting message data of cordless paging information if the same address as the self-address is input, a microcontroller for receiving data of the memory, processing data of the decoder and outputting an audio control signal, an alarm control signal and a display control signal in accordance with an output mode, an alarm unit for generating an alarm signal in accordance with the alarm control signal, a display unit for displaying a message of a paging party and state information of the cordless paging receiver in accordance with the display control signal, an audio processor having a memory for converting the message of cordless paging information into an audio signal in accordance with the audio control signal, and a speaker for audio-paging the audio signal by the control of the microcontroller.

4 Claims, 5 Drawing Sheets

AUDIO PAGING APPARATUS AND METHOD FOR CORDLESS PAGING RECEIVER

CROSS REFERENCE TO RELATED APPLICATION

This application makes reference to, incorporates the same herein, and claims all benefits accruing under 35 U.S.C. §119 from an application for Audio Paging Apparatus And Method For Cordless Paging Receiver earlier filed in the Korean Industrial Property Office on the 26th of Jun. 1995 and there duly assigned Serial No. 17607/1995.

BACKGROUND OF THE INVENTION

1. Field of the Invention

The present invention related to cordless paging receivers, and more particularly, to audio paging apparatus and processes enabling cordless paging receivers to control generation of alarm functions broadcasting audio signals during cordless paging operations.

2. Description of the Related Art

In general, a cordless paging receiver receives and analyses cordless paging information of a specific type and then if received paging information is determined to contain information related to receiver itself, initiates an alarm function.

In the hypothetical typical cordless paging receiver, when cordless paging information is received, the output mode is expressed in the form of either a tone alarm, melody alarm or oscillation alarm (e.g., a sound-free vibration alarm). The receiving party must then manually depress the operational key of the cordless paging receiver, visually check the message displayed by the pager in response to the cordless paging information, and then trigger application of an interrupt signal to the microcontroller within the pager. With this type of pager, the receiving party is required to visually check the message displayed on the display unit, a requirement that is not always convenient, particularly if the owner of the pager is otherwise engaged or if the display unit is not already within the line of sight of the owner.

Early efforts to facilitate communications with the user of a pager included multiple alert pagers such as the Radio Paging Receiver Having Pre-recorded Voice Messages Which Are Selectived By Address Codes And Read Out Responsive To A Suffix Code of Masaru Masaki, U.S. Pat. No. 4,330,780, and the Combined Tone Only And Tone Voice Multiple Alert Pager of C. J. Ganucheau, Jr., U.S. Pat. No. 4,419,668. Masaki '780 responds to reception of successive radio signals by generating a first decoded signal indicating the nature of a page, and producing a second decoded signal when a second predetermined code signal is decoded within a predetermined time after the first predetermined code signal is decoded, and selects one several digitized vocal comments stored in memory, in response to the reception of the first and second decoded signals. An alert tone is then followed by the designated one of the vocal comments retrieved from memory. The pager of Ganucheau '668 searches for predetermined signal codes within signals received that may, or may not be followed by audio frequency information, and selectively provides various audible alerts in response, depending upon the operational mode of the pager. These modes include tone only and tone and voice alarms. The Digitized Stored Voice Paging Receiver of P. T. Bennett, et al., U.S. Pat. No. 4,965,569, endeavored to receive analog information including a voice message, to digitize and store the voice message, and at the request of the user, to produce a replica of the analog signal as a voice message by reading the digitized message from memory and reconverting it into an analog signal.

Later, the Paging System Using LPC Speech Encoding With An Adaptive Bit Rate of Walter, L. Davis, et al, U.S. Pat. Nos. 4,701,943 and 4,811,376, purported to combine linear predictive coding encoded voice signals with paging signalling information in an effort to generate a composite paging signal.

More recent efforts such as the Method And Apparatus For Combining Submessages Of A Message To Form The Complete Message of Cannon, et al., U.S. Pat. No. 5,363,090, seeks to generate a lengthy message by comparing header information corresponding to a submessage with header information of previously stored submessages, and combining submessages on the basis of their header information, while the System For Reduced Congestion Of Radio Paging Channel of Yukinori Sakakura uses a radio base station with first reception announcement to request a calling number and a called number, and after converting the calling number into speech, a second, or call-back, announcement to the called party when the called party responds to the call.

Generally, I have found that these efforts lack an element of simplicity in their techniques for communicating with the called user of a pager.

SUMMARY OF THE INVENTION

It is an objective of the present invention to provide an improved cordless pager and process for operation of the pager.

It is another objective to provide an audio paging apparatus for a cordless paging receiver for performing a paging alarm in an audio signal.

It is yet another objective to provide an audio paging process enabling a cordless paging receiver to generate a paging alarm as an audio signal.

It is still another objective to provide an audio pager and process for operating the pager to generate a combination of audio messages in response to a telephone call.

It is still yet another objective to provide a pager and process for facilitating delivery of messages to the owner of the pager.

To achieve these and other objectives, there is provided an audio paging apparatus for a cordless paging receiver with a receiver for receiving cordless paging information and converting the same into digital data. A memory stores a self-address for the cordless paging receiver. A digital signal decoder receives and decodes the digital data, converting the decoded digital data into original data and transmits to a microcontroller message data for cordless paging information whenever the self-address for the cordless paging receiver is received among the cordless paging information. The microcontroller reads data from the memory, process the message data received from the decoder, and generates either an audio control signal, an alarm control signal or a display control signal, in accordance with an output mode of the message data. An alarm unit generates an alarm signal in response to the alarm control signal. A display unit visually displays message data from the paging party as well as status information representative of the operational characteristics of cordless paging receiver, in response to the display control signal. An audio processor having an internal memory, converts the message data for the cordless paging information into an audio signal in response to the audio control signal. When the paging receiver is in a tone mode, the microcontroller changes the telephone number information received or the tone signal message into audio signals, and combines the audio signals with either first or second internal audio messages stored in memory. A speaker broadcasts the audio signal under the control of the microcontroller.

To achieve these and other objectives, there is provided an audio paging process for a cordless paging receiver. The output mode of the cordless paging receiver is analyzed whenever the unique self-address for the paging receiver is received. Cordless paging information message received by the paging receiver with the self-address is converted into an audio signal when the output mode is a tone mode; the cordless paging information message is combined with a previously stored internal audio message and broadcast as audio-paging via a speaker.

BRIEF DESCRIPTION OF THE DRAWINGS

A more complete appreciation of this invention, and many of the attendant advantages thereof, will be readily apparent as the same becomes better understood by reference to the following detail description when considered in conjunction with the accompanying drawings, in which like reference symbols indicate the same or similar elements components, wherein.

DETAILED DESCRIPTION OF THE PREFERRED EMBODIMENT

Figure 1:
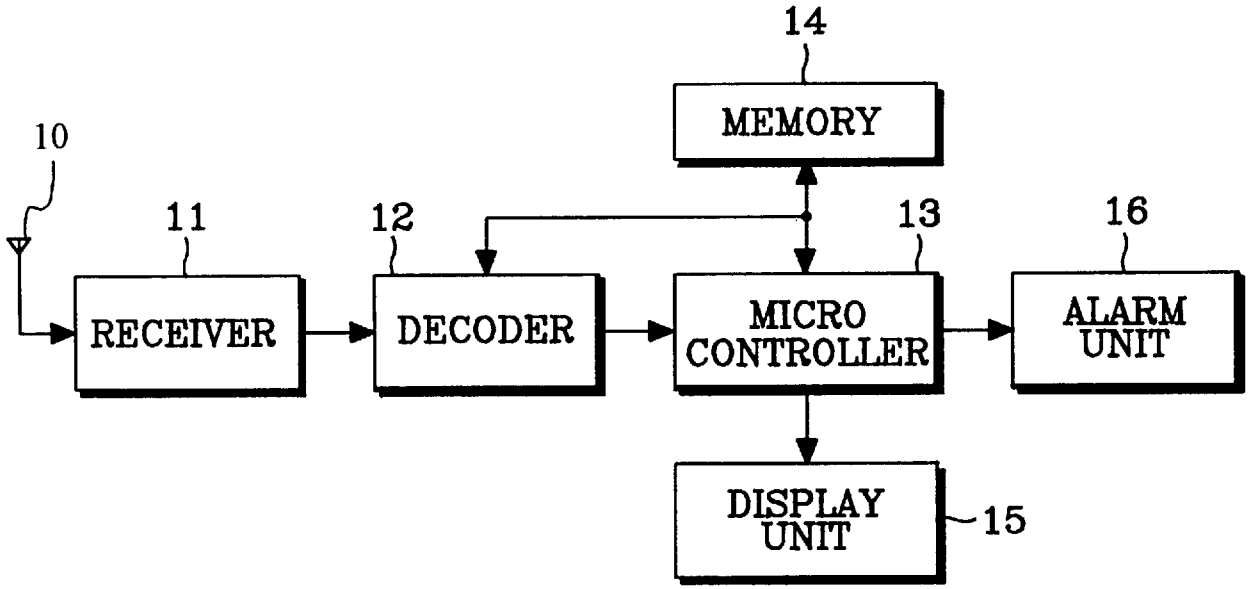
FIG. 1 is a block diagram illustrating salient features of a hypothetical typical cordless paging receiver in general current use.

FIG. 1 is a block diagram of a general cordless paging receiver. Receiver 11 receives cordless paging information via antenna 10 and performs frequency conversion, demodulation and waveform matching. The output of the receiver 11 is cordless paging information that has been converted into digital data, is applied to decoder 12. Decoder 12 decodes the applied data and sets the operational mode of the cordless paging receiver. In other words, while in an idle mode, decoder 12 controls the operational power supply for a predetermined period to detect for reception of preamble data. In a batch mode, decoder 12 detects word synchronization data and set frame data. The set detected frame data is decoded and is converted into the original data. Whenever the address of information stored in a memory 14 is found to be identical to the address information of cordless paging information received, then the message data of the cordless paging information received with the address information is detected. Then, decoder 12 decodes the paging information received for microcontroller 13. In microcontroller 13 processes the received data and controls operation of the alarming function by triggering alarm unit 16 to generate an alarm control signal such as a tone signal or an oscillation signal. Display unit 15 displays a message from the paging party and information about the state of the cordless paging receiver on a visual display controlled by microcontroller 13. Memory 14 stores intrinsic self-address information uniquely allocated to the specific cordless paging receiver, together with frame information.

Figure 2:
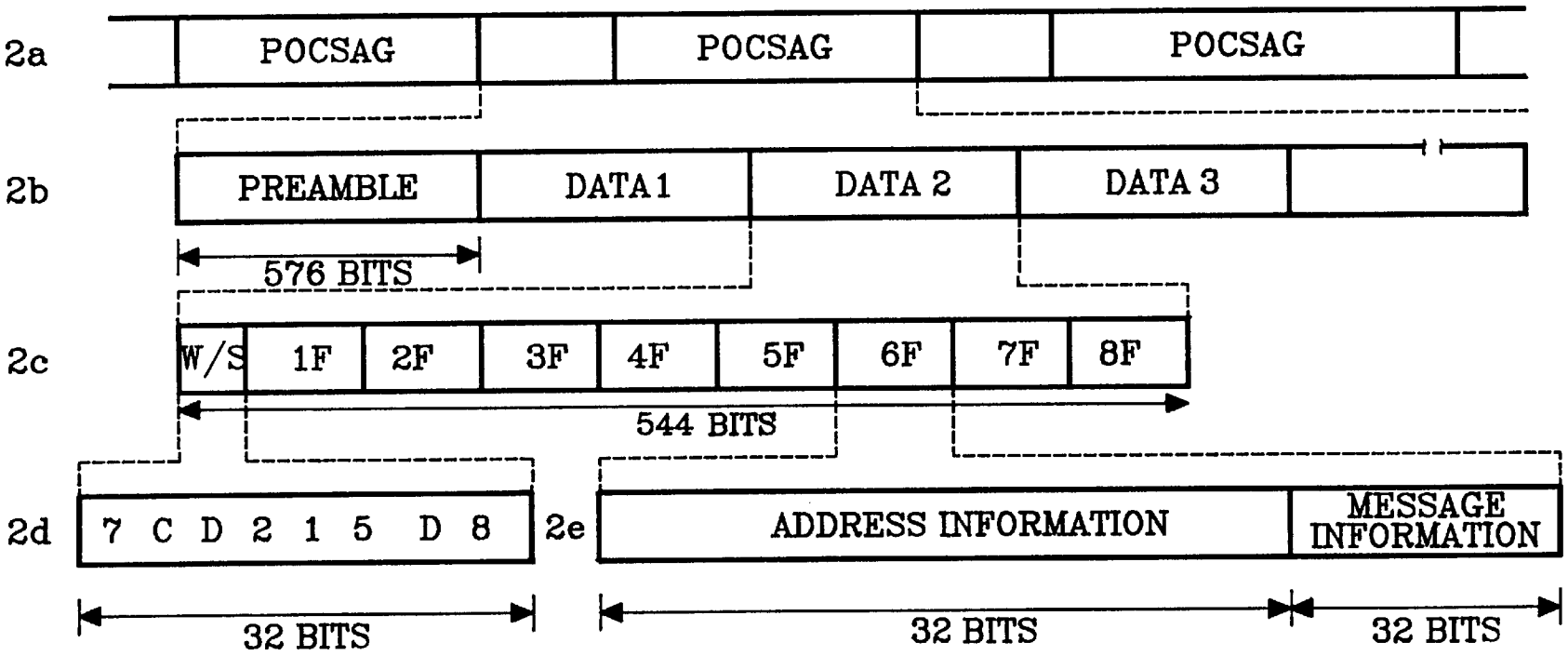
FIG. 2 shows the convention typically followed in the generation of the POCSAG codes used in cordless paging receivers of the type represented by in FIG. 1.

A convention for the types of POCSAG code used in the cordless paging receiver will be described with reference to FIG. 2. The POCSAG code is generated in such a way as is shown by line 2*a* in FIG. 2. One unit of POCSAG code is composed of 576-bits of preamble data and a multitude of sequential batch data, as is shown by line 2*b* in FIG. 2. The preamble data is a reversal code in which "1" and "0" logic values occur repeatedly during the period of 576 bits within the preamble. Also, one POCSAG code generally includes between thirty to sixty batches of data. A batch is formed by a 32-bit word of synchronization data and eight 64-bits of frame data, as is shown by line 2*c* in FIG. 2. Here, as shown by line 2*d* in FIG. 2, the word sync data is 32-bit data of "(7CD215D8)H, (01111100110100100001010111011 00)B. Also, each frame data includes a 32-bit address codeword (i.e., address information) and a 64-bit message codeword (i.e., message information), as is shown by line 2*e* shown in FIG. 2. Therefore, a batch is composed of seventeen words of 544-bits, with each word including thirty-two bits, as is represented by line 2*c* in FIG. 2.

Figure 3A:
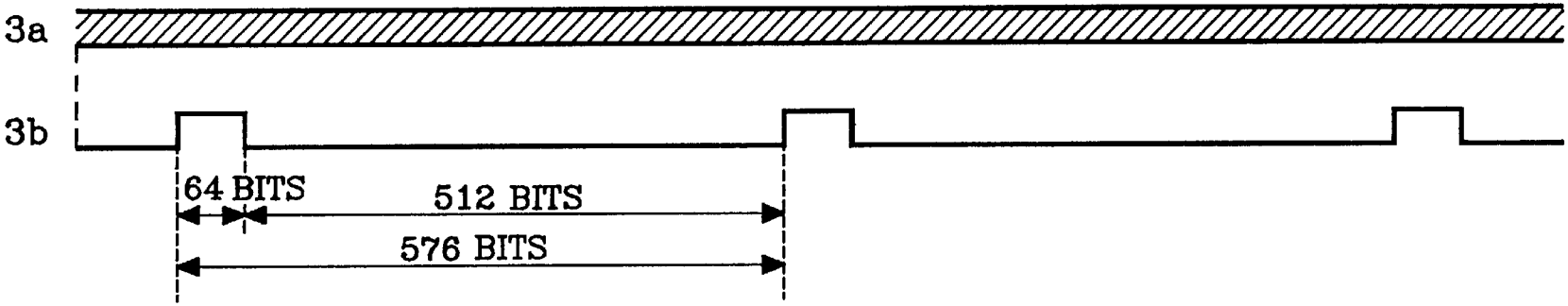
FIGS. 3A and 3B respectively show power control characteristics during an idle mode and a batch mode in a cordless paging receiver.
Figure 3B:
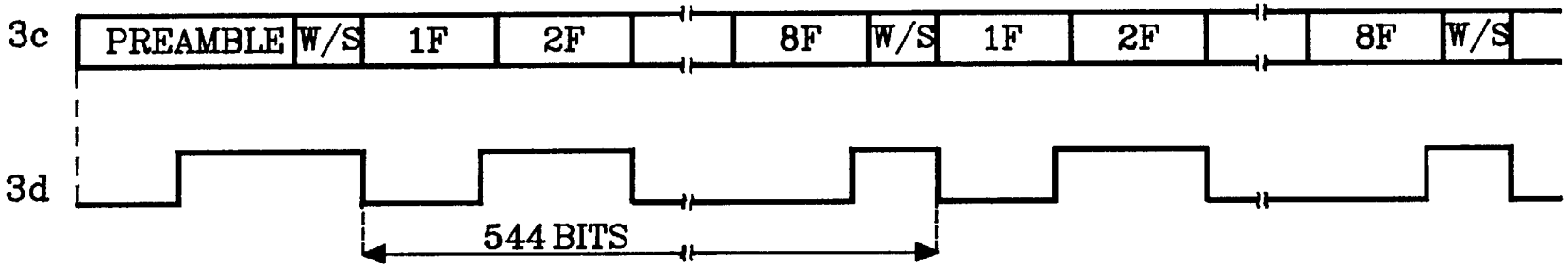

FIG. 3A shows a power control operation during an idle mode for detecting reception of preamble data. FIG. 3B shows a power control operation during a batch mode for detecting an address. Referring to FIG. 3A, the power control operation during the idle mode will be described. As shown in FIG. 2, the preamble is composed of 576-bits and "1" and "0" logic values occur repeatedly during the period of the preamble. Therefore, if power is supplied for a predetermined time during a 576-bit period, the reception of the preamble at antenna 10 can be detected. In other words, as shown in line 3*a*, of FIG. 3A, if the POCSAG code is not received, decoder 12 continues the idle mode to supply power for a 12-bit period within the unit of a 576-bit period, as is shown in line 3*b* of FIG. 3A. During such operation however, if 12-bits of the preamble data is detected during the power supply period of the idle mode, reception of the POCSAG code can be recognized.

Next, referring to FIG. 3B, the power control operation of the batch mode will be described. Decoder 12 detects reception of the preamble and supplies power, as shown by line 3*d* in FIG. 3B, while one POCSAG code is processed. In other words, a power control signal is generated to enable detection of a 32-bit word sync and a 64-bit codeword of the set frame in one unit of a batch. At this time, in general, the power is not supplied precisely during the word synchronization period or frame period, but is supplied ahead of the word synchronization period by a predetermined number of bits. This is for receiving the word synchronization and frame codeword exactly, and the power is generally supplied by eight bits or sixteen bits ahead of the word synchronization period.

In the hypothetical typical cordless paging receiver, when cordless paging information is received, the output mode is expressed in the form of either a tone alarm melody alarm or oscillation alarm (sound-free vibration alarm). At this time, the receiving party manually depresses the operational key of the cordless paging receiver and checks the message of cordless paging information, and then generates an interrupt signal and supplies the interrupt signal to the microcontroller within the pager. With this type of pager, the receiving party is required to visually check the message of cordless paging information displayed on display unit 15, a requirement that is not always readily convenient.

Hereinafter, a preferred embodiment of the present invention will be described in detail with reference to accompanying drawings. It should be noted that the same components in the drawings are represented by the same reference numerals.

A first internal audio message is an audio signal predetermined and stored in an audio processor and a second internal audio message is another audio signal predetermined and stored in the audio processor.

Figure 4:
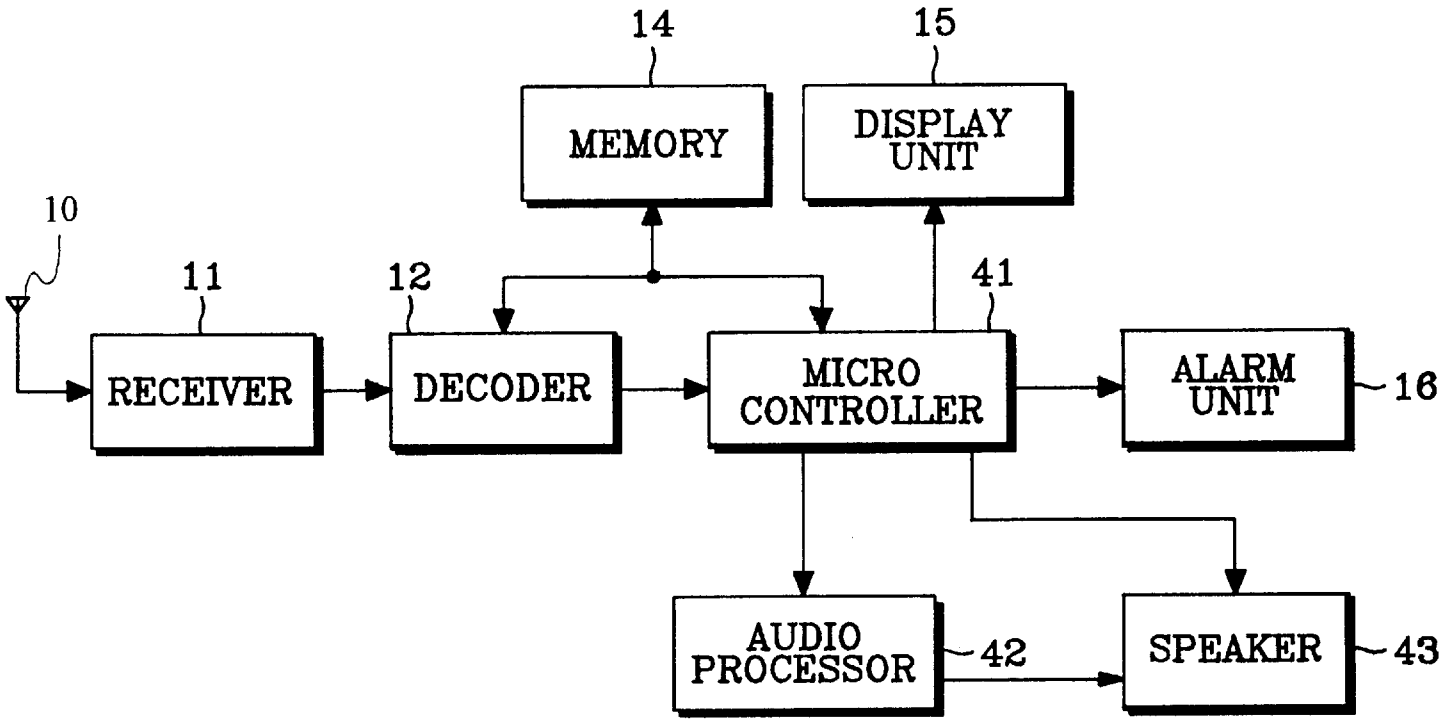
FIG. 4 is a block diagram illustrating an audio paging apparatus for a cordless paging receiver constructed according to the principles of the present invention.

Referring to FIG. 4, which is a block diagram illustrating an audio paging apparatus for a cordless paging receiver according to the present invention, a receiver 11 receives cordless paging information via antenna 10 and performs frequency conversion, demodulation and waveform matching. The digitally converted cordless paging information is applied to a decoder 12. Decoder 12 decodes the applied data and sets the operational mode of the cordless paging receiver. The decoded data generated by decoder 12 is converted into the original data. Also, if the addresses of information stored in a memory 14 and that of cordless paging information are identical, decoder 12 transmits the original data to microcontroller 41. Microcontroller 41 processes the original data in accordance with the output mode of the cordless paging receiver and generates an alarm control signal, a display control signal and an audio control signal.

First, if the output mode of the pager is set to a sound-free alarm mode, microcontroller 41 outputs the alarm control signal to an alarm unit 16. In response to the alarm control signal, alarm unit 16 drives a motor incorporated into the pager to output a paging signal in an oscillation mode (ie., as a vibration). Display unit 15 visually displays a message from the paging party in response to the display control signal received from microcontroller 41.

Next, if the output mode of the pager is set to a tone mode, microcontroller 41 analyzes the input message. Thus, microcontroller 41 outputs the message received to audio processor 42 as an audio control signal. If the input message is in a call mode type, the audio processor 42 converts the input message into an audio signal. At this time, the first internal audio message previously stored within a memory incorporated within audio processor 42 is implemented as, for example, "Mr. Gildong Hong, you are paged by 123–4567" (e.g., a telephone number). Thus, audio processor 42 receives and combines the first internal audio message and the telephone number from the input message of microcontroller 41: Then, audio processor 42 broadcasts the audio message via speaker 43. Also, if the output mode of the cordless paging information received corresponding to the message input to microcontroller 41 is a type of mode other than the call mode, the input message is output to audio processor 42 by the audio control signal. Then, the audio processor 42 converts the input message into an audio signal and combines the input message with the second internal audio message prestored in audio processor 42. At this time, the second internal audio message is implemented as, for example, "Mr. Gil-dong Hong, this is a XEX signal.". The thus-combined audio message is output to speaker 43 and is broadcast in the audio paging mode.

Figure 5:
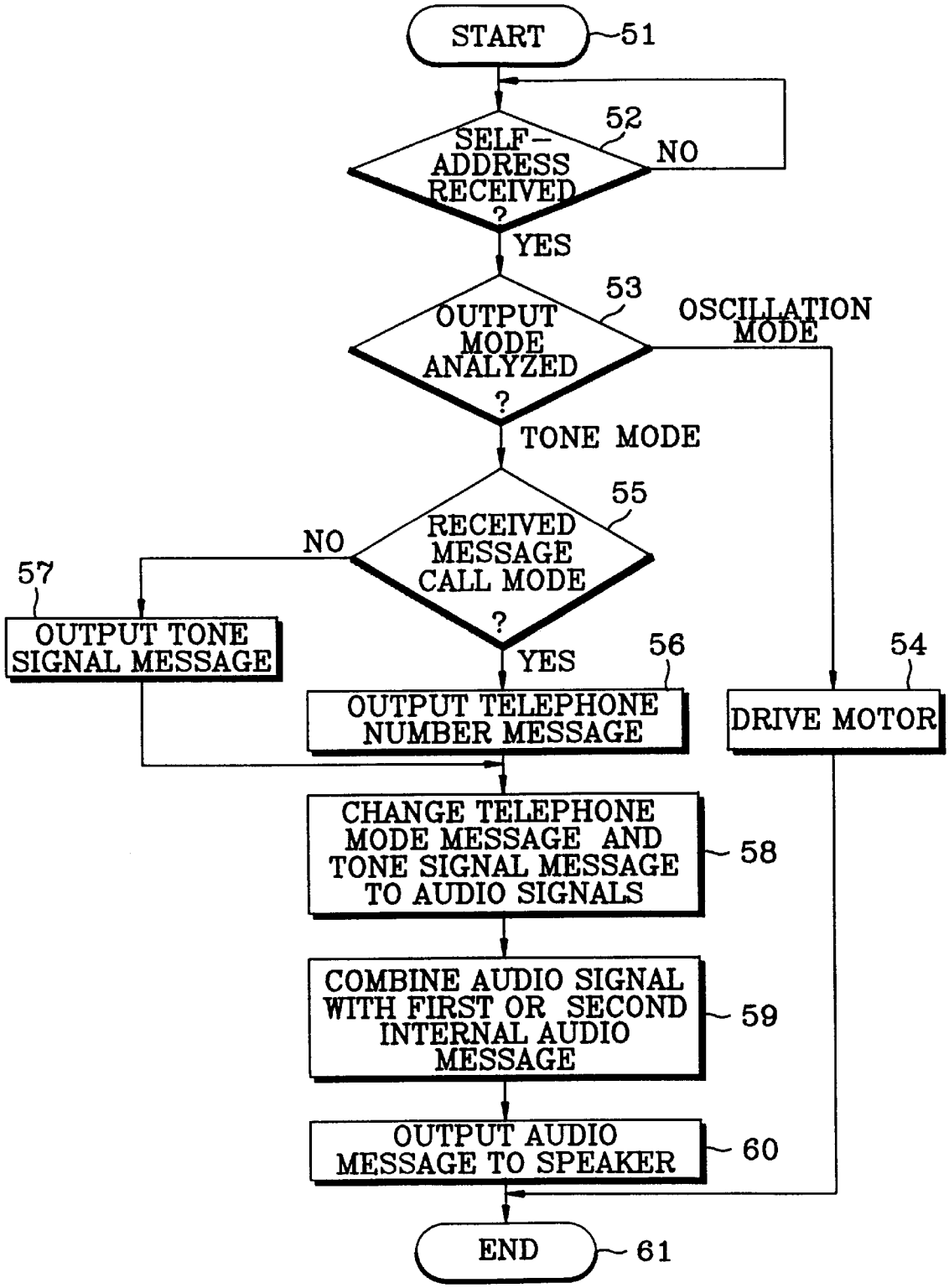
FIG. 5 is a flow chart illustrating a technique for operation of a cordless audio pager according to the principles of the present invention.

Referring now to FIG. 5, which is a flow chart illustrating an audio paging process for controlling the operation of a cordless paging receiver according to the principles of the present invention, with initialization of microcontroller 41 in start step 51. Then, in step 52, decoder 12 analyzes whether the address of input paging information is the same as the self-address stored in memory 14. If the address is the same, the output mode of the cordless paging receiver is analyzed in step 53. If the output mode is an oscillation mode, microcontroller 41 controls alarm unit 16 to drive the motor in step 54 and performs the alarm paging as the oscillation (i.e., a vibration) mode. If the output mode of the cordless paging receiver is determined to be a tone mode in step 53, microcontroller 41 outputs the input message to audio processor 42. At this time, if the mode of the input message is determined in step 55 to have a type of mode other than the call mode, a tone signal message received in step 57 is applied by microcontroller 41 to audio processor 42. Also, in step 55, if the input message is determined to be the call mode, a phone number message is applied to audio processor 42 in step 56. Then, in step 58 audio processor 42 converts the call mode message and tone signal message into an audio signal. In step 59, the audio signal is combined with the previously stored first or second internal audio messages to then be broadcast via speaker 43. At this time, when the phone number message is to be broadcast, the audio signal is combined with the first internal audio message in step 59. When a tone signal message is received however, the audio signal is combined with the second internal audio message. The cordless paging receiver broadcasts the audio message via speaker 43 in step 60.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An audio paging apparatus for a cordless paging receiver, comprising:

means for receiving cordless paging information and converting said cordless paging information into digital data;

memory means for storing a self-address of said cordless paging receiver;

decoding means for receiving and decoding said digital data, converting said digital data into original data and outputting message data of said cordless paging information if a same address as the self-address is input;

a microcontroller for receiving data of said memory means, processing data of said decoding means and outputting an audio control signal, an alarm control signal and a display control signal in accordance with an output mode;

alarming means for generating an alarm signal in accordance with said alarm control signal;

displaying means for displaying a message of a paging party and state information of said cordless paging receiver in accordance with said display control signal;

audio processing means having a memory for converting a message of said cordless paging information into an audio signal in accordance with said audio control signal, wherein said audio processing means stores a first internal audio message and a second internal audio message by said memory means, combines said audio signal with first internal audio message into a first combined audio message if the mode of said cordless paging information is a call mode, and combines said audio signal with said second internal audio message into a second combined audio message if the mode of said cordless paging information is a mode other than said call mode; and a speaker for audio-paging said first combined audio message and said second combined audio message by the control of said microcontroller.

2. The audio paging apparatus for a cordless paging receiver as claimed in claim 1, wherein said microcontroller analyzes a mode type of said cordless paging information.

3. An audio paging method for a cordless paging receiver, comprising the steps of:

receiving cordless paging information by said cordless paging receiver;

storing a self-address in a memory of said cordless paging receiver;

analyzing an output mode of the cordless paging receiver if a same address as the self-address of said cordless paging receiver is input;

converting said cordless paging information into an audio signal if said output mode is a tone mode;

combining said cordless paging information with a first prestored internal audio message into a first combined audio message if said cordless paging information is a call mode, and audio-paging said first combined audio message to a speaker; and combining said cordless paging information with a second prestored internal audio message into a second combined audio message if said cordless paging information is a mode other than said call mode, and audio-paging said second combined audio message to said speaker.

4. An audio paging method for a cordless paging receiver, comprising the steps of:

receiving cordless paging information by said cordless paging receiver;

storing a self-address in a memory of said cordless paging receiver;

analyzing an output mode of the cordless paging receiver if a same address as the self-address of said cordless paging receiver is input;

combining an audio signal with a prestored first internal audio message into a first combined audio message if said output mode is a tone mode and said cordless paging information is a call mode;

combining an audio signal with a prestored second internal audio message into a second combined audio message if said output mode is a tone mode and said cordless paging information is a mode other than a call mode;

audio-paging to a speaker said first combined audio message if said cordless paging information is said call mode; and audio-paging to a speaker said second combined audio message if said cordless paging information is a mode other than said call mode.

* * * * *